US005458146A

United States Patent [19]

Gregg

[11] Patent Number: 5,458,146

[45] Date of Patent: Oct. 17, 1995

[54] PORTABLE BIVOUAC SHELTER

[76] Inventor: Ron Gregg, 2203 1st Ave. South, Seattle, Wash. 98134-1424

[21] Appl. No.: 105,884

[22] Filed: Aug. 11, 1993

[51] Int. Cl.[6] ..... E04H 15/10

[52] U.S. Cl. ..... 135/91; 135/137; 135/148; 135/117; 5/413

[58] Field of Search ..... 135/87, 95, 96, 135/102, 109, 112, 117, 91, 137, 140, 148, 151, 155, 156; 5/112, 113, 413, 414, 415, 411

[56] References Cited

U.S. PATENT DOCUMENTS

| | | | |
|---|---|---|---|
| 3,941,140 | 3/1976 | Beavers | 135/109 |
| 3,995,649 | 12/1976 | Robichaud | 135/102 |
| 4,530,123 | 7/1985 | Mathou | 5/411 X |
| 4,605,029 | 8/1986 | Russell | 5/413 X |
| 4,716,918 | 1/1988 | Hayashida et al. | 135/102 X |
| 4,719,935 | 1/1988 | Gustafson | 135/102 |
| 4,914,768 | 4/1990 | Howard | 5/414 X |
| 4,939,803 | 7/1990 | Waters | 5/414 |

*Primary Examiner*—Lanna Mai

*Attorney, Agent, or Firm*—Riddell, Williams, Bullitt & Walkinshaw

[57] ABSTRACT

A portable bivouac shelter (10) is provided having an end pole (48) retaining on the top sheet (12) through a tunnel (46) for holding the top sheet (12) in a taught and semi-circular configuration. This permits the top sheet (12) to be held away from the bottom sheet (14) in an open configuration for enhanced ventilation. A top pole (54) is also provided across the top sheet 12 near the head end (20). The top pole (54) cooperates with the flexible end pole (48) to form a sloped roof over a user's head and to hold the top and bottom sheets (12) and (14) in a selected degree of an open configuration. Optional mounting snaps (62) in the interior (24) of the enclosure (18) enable a user to reconfigure the opening (26) without leaving the interior (24) of the shelter (10). The shelter (10) thus provides enhanced ventilation while the sloped roof formed by the top pole (54) prevents the entry of precipitation into the enclosure (18). Optional mosquito netting (32) is zippered on the interior of the opening (26).

7 Claims, 3 Drawing Sheets

PORTABLE BIVOUAC SHELTER

TECHNICAL FIELD

The present invention pertains to one-person shelters, commonly referred to as bivouac sacks and, more particularly, to a portable bivouac sack having cooperating support members that enable selective configuration of the opening to enhance ventilation while sheltering the user from the elements.

BACKGROUND OF THE INVENTION

Field of the Invention: Mountaineers, kayakers, cyclists, and other travelers who wish to minimize the weight they must carry often sleep in bivouac sacks rather than tents. Such bivouac sacks are typically formed of elongated fabric envelopes or enclosures that are sized and shaped to fully enclose one person inside a large sleeping bag and provide extra volume around the person's head. In the past, the top sheet of fabric has consisted of two pieces that overlap generally near the chest area to enable ingress and egress. The overlap is usually sufficient to minimize entry of precipitation, but not enough to fully prevent it. Providing enough ventilation to the interior of the bivouac sack without allowing large amounts of precipitation to enter is essentially impossible with such designs.

An alternative means of entry has been provided in the some bivouac sacks wherein an opening is formed, either along the margin at the head end or along the margin at the side. Here again, this design fails to provide enough ventilation while preventing the entry of precipitation during periods of rain or snow.

Existing bivouac sacks provide only a minimal amount of adjustability in the amount of ventilation provided to the interior. In most cases, a zipper used to close the sack is the only available means user has for adjusting the size of the opening and controlling ventilation. This method, however, requires the user to pull the top of the sack back from the head to allow more ventilation, thus exposing the user's head to the elements. While mosquito netting can be used to block insects, the user's head is still subject to precipitation and the elements.

Hence, there is a need for a portable bivouac shelter that enables selective positioning of the top sheet of the sack and holding of the top sheet in either a partially open or fully open position while still protecting the user's head. It is further desirable that such a shelter allow a user to reposition the opening while remaining inside the shelter and without having to remove mosquito netting or otherwise exposing the user to the elements.

SUMMARY OF THE INVENTION

A portable bivouac shelter for sleeping is provided. The shelter formed in accordance with the present invention comprises a flexible enclosure that defines an elongated interior having a head end and a foot end, with the head end having an opening that communicates with the interior. The shelter further includes a shape-retaining member positioned at the head end for holding at least one-half of the perimeter of the opening at the head end in a predetermined shape whereby a user can selectively adjust the opening to different degrees of an open configuration.

In accordance with another aspect of the present invention, the shelter further includes a support member mounted near the head end for holding the enclosure near the head end in an open configuration. The support member and the shape retaining member cooperate to hold the opening in an open configuration and to form a sloped roof at the head end whereby ventilation is enhanced and precipitation is prevented from entering the interior of the enclosure.

In accordance with yet another aspect of the present invention, two or more attachment points are provided in the interior of the enclosure for adjusting the mounting position of the shape retaining member to thereby enable positioning of the opening at selected degrees of the open configuration.

In accordance with still yet another aspect of the present invention, adjustable straps are provided in the interior of the enclosure for holding a sleeping pad in position in In accordance with yet another aspect of the present invention, the support member and the shape retaining member are formed from flexible poles that are snapped into position on the enclosure.

In accordance with yet a further aspect of the present invention, mosquito netting is attached at the opening, preferably by zipper, to prevent the entry of insects into the interior of the enclosure.

As will be readily appreciated from the foregoing description, the present invention permits a large amount of ventilation during periods of precipitation without allowing any water entry. In addition, the portable bivouac shelter of the present invention provides an enormous amount of ventilation during hot weather, especially when insects are present, without allowing insects to enter. The present invention enables a user to quickly reconfigure the degree of opening in the bivouac shelter for such extremes without having to leave the bivouac shelter or expose himself to the elements.

Another benefit of the present invention is the minimization of damage that often is inflicted on the upper fabric when a user slides or rolls over on to it. This is accomplished by the adjustable straps inside the shelter to hold a sleeping pad in position on the bottom fabric. Since the top sheet of fabric is often constructed with a semipermeable membrane, vapor transport out of the shelter is reduced whenever part of the upper fabric gets under the sleeping pad. The straps of the present invention prevent this from occurring under normal conditions.

BRIEF DESCRIPTION OF THE DRAWINGS

The foregoing and other features and advantages of the present invention will be more readily appreciated as the same becomes understood from the detailed description when taken in conjunction with the following drawings, wherein.

DETAILED DESCRIPTION OF THE PREFERRED EMBODIMENT

Figure 1:
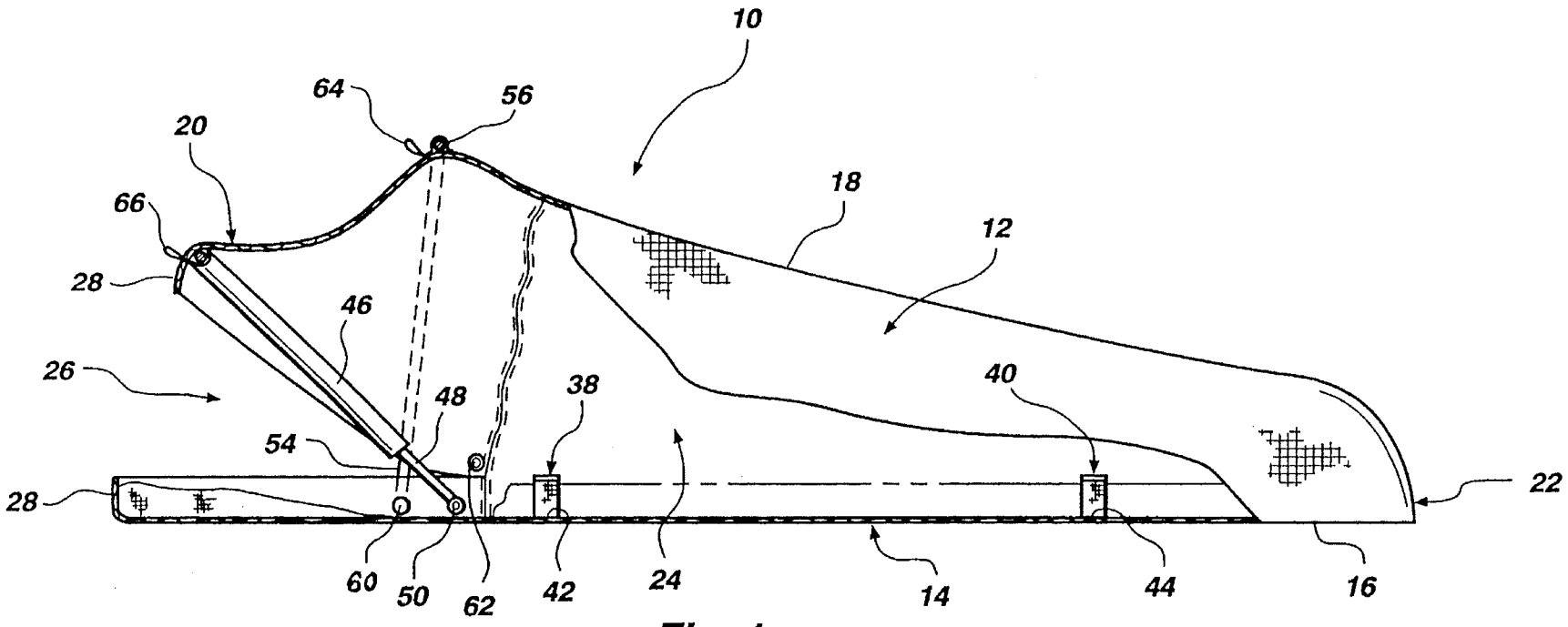
FIG. 1 is a side view in partial cutaway of a portable bivouac shelter formed in accordance with the present invention.

Referring initially to FIG. 1, illustrated therein is a portable bivouac shelter 10 formed in accordance with the present invention. The shelter 10 is formed from a top sheet 12 that is sewn to a bottom sheet 14 along a circumscribing seam 16. The top and bottom sheets 12 and 14 thus form an enclosure 18 having a head end 20 and foot end 22 that define an interior 24. An opening 26 formed in the head end 20 provides access to the interior 24.

In the preferred embodiment, the top sheet 12 is constructed of ultra-lite 3-layer GORE-TEX® fabric (available from W. L. Gore and Associates) or other similar material made with a 1.1 ounce ripstop face fabric. It extends almost to the ground around the entire shelter 10 for maximum vapor transport when the shelter 10 is in normal use. The bottom sheet 14 is preferably formed from 1.7 taffeta with the HYDROSEAL-200® coating available from Outdoor Research, Inc., in Seattle, Wash. Every seam is taped for total waterproofness, preferably with GORE-SEAM® tape.

The opening 26 is defined by a perimeter 28 of reinforced fabric along the top sheet 12 and the bottom sheet 14.

Figure 3:
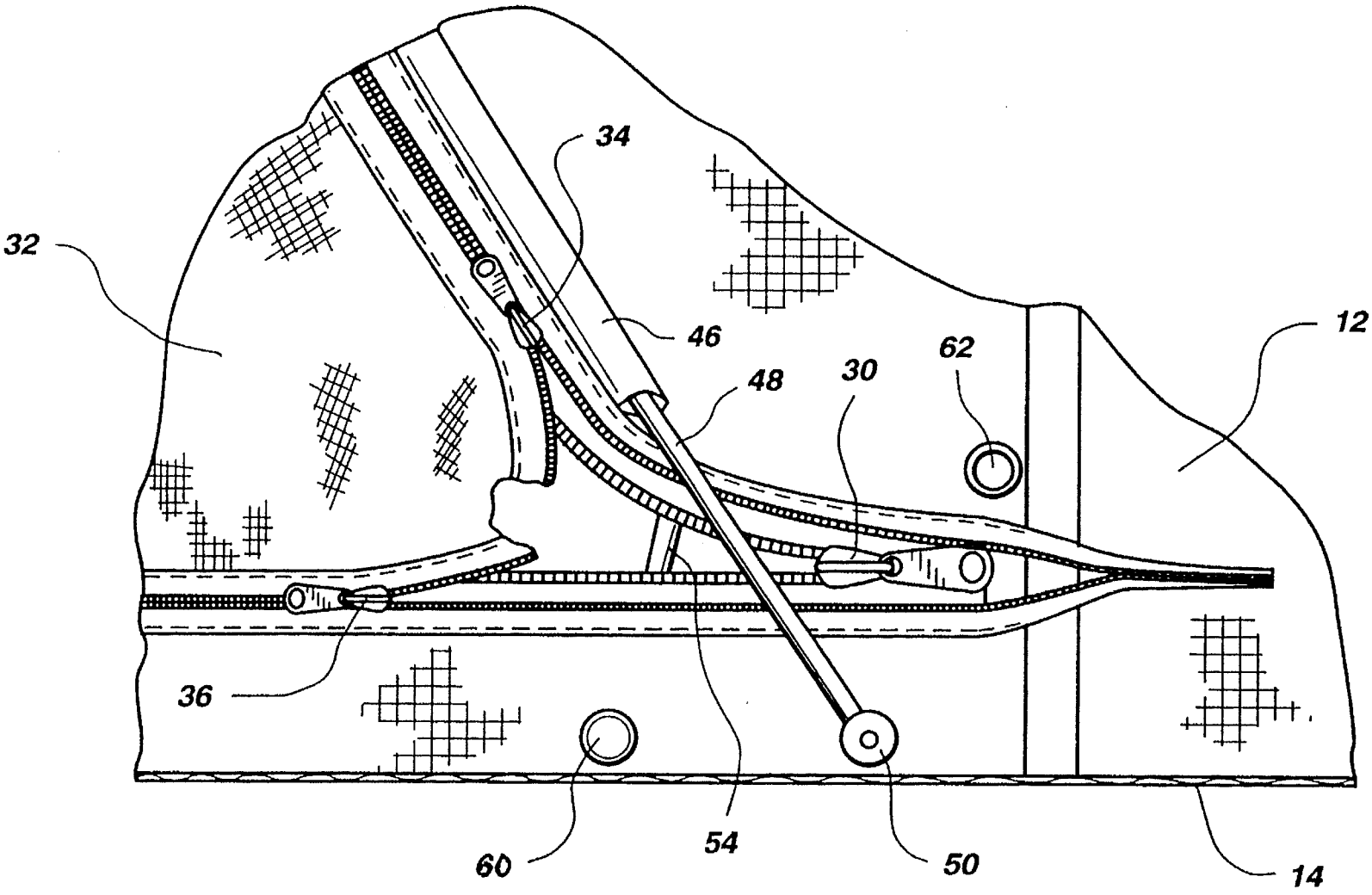
FIG. 3 is an enlarged side view of the interior at the head end of the shelter of FIG. 1 illustrating the zipper arrangement.

The top sheet 12 and bottom sheet 14 are preferably held together at the opening 26 by means of a primary zipper 30, which is shown more clearly in the enlarged view of the interior 24 in FIG. 3. The primary zipper is accessible from the interior 24, and also from the exterior of the shelter 10 when the primary zipper 30 is unzipped. Optional mosquito netting 32 can be attached to the top and bottom sheets 12 and 14. As shown more clearly in FIG. 3, the netting 30 is zippered to the reinforced perimeter 28, preferably by means of a pair of zippers 34 and 36, one along the top sheet 12 and one along the bottom sheet 14. It is to be understood, however, that a single zipper running around the entire perimeter 28 of the opening 26 could also be used.

The pair of netting zippers 34 and 36 are mounted on the interior side of the primary zipper 30 and run parallel to each half of the primary zipper 30 on the top and bottom sheets 12 and 14. As with the primary zipper 30, each of the netting zippers 34 and 36 can be opened and closed from either the interior 24 of the enclosure 18 or from the exterior.

In the interior 24 of the enclosure 18 are mounted forward straps 38 near the head end 20 and the rearward straps 40 near the foot end 22. Each of the straps 38 and 40 consist of two pieces of flexible filament, each having one end 42 and 44 attached, preferably by sewing, to the bottom sheet 14 of the enclosure 18. The other ends (not shown) are unattached and can be selectively connected to the corresponding filament by means of snaps, buckles or preferably hook and loop fasteners. These straps 38 and 40 are used to hold a sleeping pad in position on the bottom sheet 14. This prevents the pad from slipping onto top sheet 12, causing damage and loss of ventilation. These straps 38 and 40 can also be used in bivouac shelters that have no support poles.

Figure 2A:
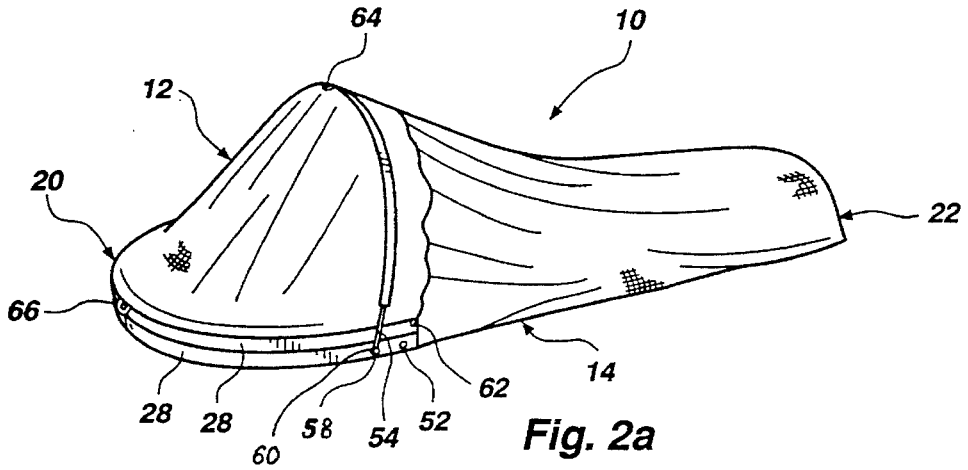
FIGS. 2A–C are isometric projections of the portable bivouac shelter of FIG. 1, showing three potential configurations for the opening.
Figure 2B:
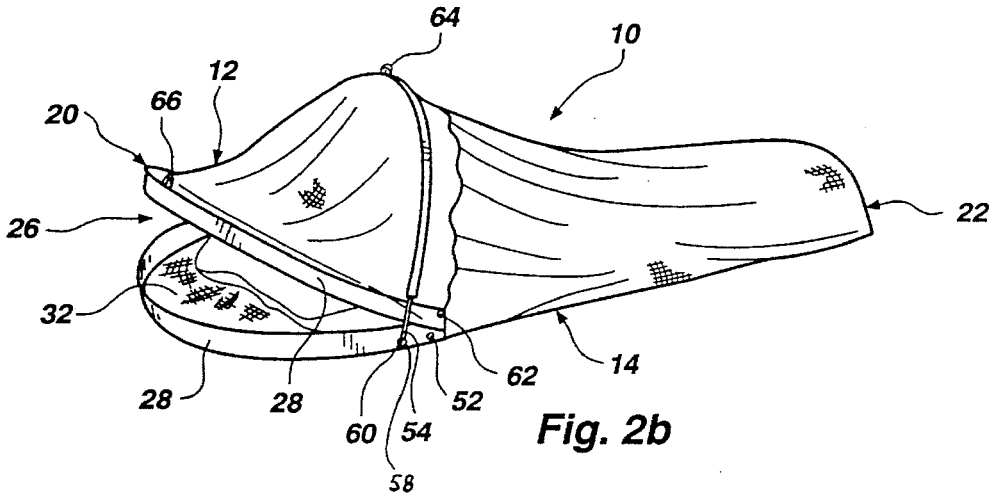

Along the exterior of the perimeter 28 on the top sheet 12 is formed a fabric tunnel 46 that is sized and shaped to slidably receive a flexible end pole 48. Ideally, the end pole 48 is formed of hollow segments held together by means of a shock cord. This allows the end pole 48 to be broken down for storage and transportation. The pole 48 has a male snap member 50 mounted on each end. Corresponding female snap members 52 and 62 are attached to the interior 24 of the top sheet 12 to which the male snap member 50 can be connected. Thus, when the end pole 48 is slid through the tunnel 46 and the snap members 50 and 62 are connected together (as shown in FIGS. 2A–2B), the pole forces the perimeter 28 of the top sheet 12 into a taut condition, holding it in the shape of an arc or semi-circle.

With the end pole 48 mounted in the rearward female snap member 62, the top sheet 12 can be propped open, such as with a boot, to provide ventilation to the interior 24 of the shelter 10. Thus, this end pole 48 facilitates holding the top sheet 12 away from the head of a user to protect the user from precipitation and exposure to other elements while allowing for selected degrees of ventilation.

Another feature of the present invention is a top pole 54 mounted in a second tunnel 56 formed across the top sheet 12 near the head end 20. The top pole is attached to the exterior of the top sheet 12 by means of male snap members 58 on the ends of the top pole 54 and female snap members 60 on the exterior of the top sheet 12. The top pole 54 is constructed of hollow pole sections held together by a shock cord in the same manner as the flexible end pole 48. With the top pole 54 snapped in place, the top sheet 12 is stretched taut near the head end 20 to hold the top sheet 12 away from the bottom sheet 14 along the entire width of the top sheet 12. The top pole 54 thus forms the top sheet 12 into a sloped roof or awning over the user's head to force the run off of precipitation and hold the top sheet 12 away from the head of a user.

In addition, the top pole 54 and end pole 48 cooperate to provide tension on the top sheet 12 so that when the primary zipper 30 is unzipped, the top sheet 12 can be pulled up off the bottom sheet 14. In other words, the opening 26 can be held in a partially opened configuration to provide increased ventilation to the interior 24 of the shelter 10. If additional ventilation is required, the top sheet 12 can be pushed further up and held in place, such as by a boot or backpack.

The opening 26 can be further enlarged by moving the mounting points of the end pole 48 to a lower and more forward (towards to the head end) position as shown more clearly in FIGS. 1 and 3. Female snap members 52 are shown in FIG. 1 being mounted lower and more forward than the female snap members 62. Thus, when the end pole 48 is mounted in the female snap members 52 in the interior 24 of the shelter 10, the top sheet 12 can be pulled to a fully open position, which is depicted more clearly in FIG. 2C.

If the top pole 54 is not used, or if additional support or security is needed, an optional loop 64 is provided on top of the second tunnel 56 respectively, to allow a user to hold the top sheet 12 in position by tying a string or rope to the loop 64 and attaching the other end of the string or rope to a support member, such as a tree. A forward loop 66 on the perimeter 28 at the head end 20 can similarly be used for additional support. Loops can also be provided for staking down the bottom sheet 14.

Figure 2C:
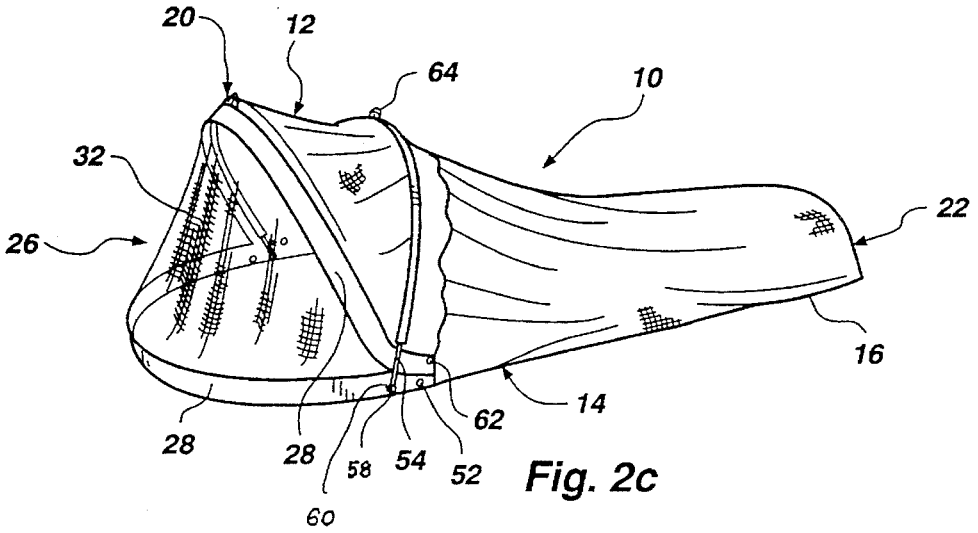

Referring next to FIGS. 2A–2C, the set up and use of the portable bivouac shelter 10 will be described. In the preferred embodiment, the end pole 48 has five sections held together by a shock cord. They are first slipped into each other to form a single pole that is then slid inside the end tunnel 46 on the sheet 12. Initially, the ends of the pole 48 are snapped to the rearward female snap members 62 on the interior 24 of the enclosure 18. Similarly the top pole, preferably having only four sections, is placed together into a single pole and slid into the exterior second tunnel 56 on the top sheet 12 and snapped to the exterior snap members 60. Once the shelter 10 is set up, the sleeping pad, if used, should be retained in place on the bottom sheet 14 by the forward straps 38 and rearward straps 40.

During very inclement weather, such as rain and snow, the primary zipper 30 is closed most or all of the way. The shelter 10 will now appear as in FIG. 2A. With the primary zipper 30 unzipped several inches, precipitation will not be allowed in because of the sloped roof formed the top pole 54. In this configuration, the end pole 48 is snapped into the rearward or optional snap members 62.

When ventilation is desired during periods of rain or snow showers, the primary zipper 30 can be fully opened and the top sheet 12 can be lifted slightly from the bottom sheet 14. This increases the ventilation to the interior 24 while still protecting the user's head. In other words, this configuration provides the additional benefit of keeping rain from getting in the shelter 10 without having to actually exit the shelter 10 and exposing the user to mud, water, etc. It is important to make sure that the portion of the perimeter 28 along the bottom sheet 14 is pulled in under the opened top sheet 12 to prevent runoff of water directly into the shelter 10.

During periods of nicer weather, the ends of the end pole 48 can be unsnapped from the rearward or optional snap member 62 and snapped into the forward snap members 52. This will force the top sheet 12 away from the bottom sheet 14, as depicted in FIG. 2B. This is ideal for nights with heavy dew. The user stays completely dry while getting greatly enhanced ventilation. If necessary, the mosquito netting 32 can be zipped into the opening 26.

With the end pole 48 snapped in this position, it is easy for a user to move the sloped roof completely open by pulling the top sheet 12 towards the top pole 54 and then pushing both poles 48 and 54 so they are positioned flat across the user's body. Thus, the user can start out with the sloped roof fully open, move it to the orientation depicted in FIG. 2 when the dew gets too heavy, and then flip it open again in the morning.

For extremely hot weather, the shelter 10 can be configured as shown in FIG. 2C. With the end pole 48 snapped in the forward snap member 52 (which is easy to do when a user is actually inside the shelter 10) and with both zippers 34 and 36 on the mosquito netting 32 fully closed, the end pole 48 is positioned vertically or nearly vertically. The slack fabric between the end pole 48 and top pole 54 is tucked behind the top pole 54 to hold the end pole 48 in the vertical or nearly vertical position. Of course, if there are not insects, the mosquito netting 32 can be unzipped and stored.

While a preferred embodiment of the invention has been illustrated and described, it is to be understood that various changes can be made therein without departing from the spirit and scope of the invention. Consequently, the invention is to be limited only by the scope of the claims that follow.

The embodiments of the invention for which an exclusive property or privilege is claimed are defined as follows:

1. A portable shelter, comprising a flexible enclosure that defines an elongated interior sized and shaped to receive one person and that includes a head end and a foot end, said head end having an opening that communicates with said interior, and means for retaining at least one-half of the perimeter of said opening at said head end in a predetermined shape, said enclosure including a top sheet and a bottom sheet and further including a support member mounted near said head end of said enclosure said support member is secured to said top sheet to move said top sheet of said enclosure up off a bottom sheet of said enclosure to form a sloped roof, said support member and said shape retaining means cooperating to enable a user to adjust said opening to a selected degree of an open configuration while remaining inside said enclosure, and to continually form a sloped roof at said head end, whereby ventilation is enhanced and precipitation is prevented from entering said interior of said enclosure.

2. The enclosure of claim 1, wherein said enclosure further includes means in said interior for holding a sleeping pad in said interior.

3. The shelter of claim 1, further including a support member mounted near said head end of said enclosure for holding a top sheet of said enclosure up off a bottom sheet of said enclosure to form a sloped roof, said support member and said shape retaining means cooperating to enable a user to adjust said opening to a selected degree of said open configuration and to continually form a sloped roof at said head end whereby ventilation is enhanced and precipitation is prevented from entering said interior of said enclosure.

4. The shelter of claim 1, wherein said shape retaining means is formed from a flexible pole means, and further wherein said flexible enclosure includes two or more mounting means in said interior for each end of said shape retaining means to enable attachment of said shape retaining means at various positions on said enclosure by a person inside said enclosure.

5. The shelter of claim 4, wherein said mounting means comprises snaps.

6. The shelter of claim 4, further including mosquito netting removably attached to said enclosure at said opening.

7. The shelter of claim 6, further comprising a primary zipper means for closing said opening and a secondary zipper means positioned interior of and parallel to said primary zipper means for removably attaching said mosquito netting to said opening of said enclosure.

* * * * *